United States Patent [19]

Giannetti

[11] 4,215,491

[45] Aug. 5, 1980

[54] SHOWER BOOT

[76] Inventor: Anthony Giannetti, 36 Highland St., Paterson, N.J. 07524

[21] Appl. No.: 11,091

[22] Filed: Feb. 9, 1979

[51] Int. Cl.[2] ..... A43B 5/08

[52] U.S. Cl. ..... 36/8.1

[58] Field of Search ..... 36/8.1, 4, 7.1, 7.3, 36/109, 110, 118

[56] References Cited

U.S. PATENT DOCUMENTS

| | | | |
|---|---|---|---|
| 1,291,958 | 1/1919 | Lund | 36/8.1 |
| 1,959,359 | 5/1934 | Hebig | 36/8.1 |
| 2,185,762 | 1/1940 | Cox | 36/8.1 |

*Primary Examiner*—Patrick D. Lawson

*Attorney, Agent, or Firm*—Clarence A. O'Brien; Harvey B. Jacobson

[57] ABSTRACT

A shower boot to be worn by a person when taking a shower for washing and scrubbing the feet. The shower boot includes a hollow body of waterproof material shaped to generally conform with and enclose the foot, ankle and lower leg region with the upper end thereof flaring or tapering outwardly to funnel water into the interior of the boot. A soft resilient lining is provided in the boot with the lining having a plurality of small projecting knobs, prongs or nipples engaging the exterior skin surface of the foot, ankle and lower leg regions of the person wearing the boot, whereby normal movement of such a person when taking a shower and towel drying will effectively wash, scrub and massage the foot and adjacent regions of the ankle and lower leg, thereby enabling such areas to be maintained in a clean and healthy condition.

6 Claims, 3 Drawing Figures

SHOWER BOOT

BACKGROUND OF THE INVENTION

1. Field of the Invention

The present invention generally relates to a shower boot for placement on each foot of a person when taking a shower with the boot including a soft lining with soft projections thereon engaging the skin surface of the foot, ankle and lower leg region of the person using the device and the upper end of the boot and lining being flared outwardly to funnel water falling downwardly or flowing along the leg surfaces due to gravity into the interior of the boot, thereby effectively soaking, washing, scrubbing and massaging the foot and adjacent areas.

2. Description of the Prior Art

When taking a shower bath, it is quite difficult and to effectively wash the feet. Normally, a person will stand precariously on one foot while soaping and scrubbing the other foot. This technique and procedure can be quite dangerous when the surfaces on which the person is standing are wet and soapy and many accidents with resultant injuries have occurred due to falls encountered when taking showers. Another technique which has been used is setting on the edge of the bath tub to wash the feet either before taking the shower or after taking the shower which procedure is not too desirable. Other solutions which have been tried include the provision of foot bath tubs and the like which enable the feet to be washed completely independently of a shower bath or bath tub. The following U.S. patents disclose various devices associated with the feet to assist in washing, scrubbing and soaking the feet:

Nos: 2,565,751—Aug. 28, 1951
3,026,540—Mar. 27, 1962
3,055,357—Sep. 25, 1962
3,548,439—Dec. 22, 1970
3,674,374—July 4, 1972
3,722,113—Mar. 27, 1973.

SUMMARY OF THE INVENTION

An object of the present invention is to provide a shower boot to be worn on each foot of a person taking a shower bath for soaping, scrubbing, washing and massaging the feet, ankles and adjacent lower leg regions during the normal movement of the feet when taking the shower bath.

Another object of the invention is to provide a shower boot for the purpose set forth in the preceding object which includes an exterior body of waterproof, resilient, flexible material, such as rubber or plastic, which is shape sustaining and is constructed to conform with and rather loosely receive the foot, ankle and lower leg region of a person wearing the boot with the outer sole portion of the boot being provided with a tread or other structure to prevent slipping of the boot in relation to wet and soapy surfaces normally found in bath tubs, shower stalls, and the like.

A further object of the invention is to provide a shower boot in accordance with the preceding objects in which the upper end of the outer body is outwardly flared or tapered to provide a funnel to guide water into the interior of the boot.

Still another object of the present invention is to provide a shower boot in accordance with the preceding objects in which the outer body is provided with an inner liner of soft, resilient, flexible material, such as rubber, plastic, or the like, with the liner conforming with the interior surfaces of the outer body and having the top edge thereof folded over the upwardly and outwardly flared top edge thereof for securing the liner in position with the interior of the liner including inwardly extending projections, knobs, prongs, nipples, or the like, of soft, resilient material, such as rubber, plastic, or the like, to facilitate washing, scrubbing and massaging of the areas of the foot and adjacent regions engaged thereby.

Yet another important object of the present invention is to provide a shower boot in accordance with the preceding objects which is simple in construction, easy to use, effective for cleaning the exterior surfaces of the feet, ankles, and adjacent leg regions and reducing the possibility of accidental slipping and falling while taking a shower bath.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
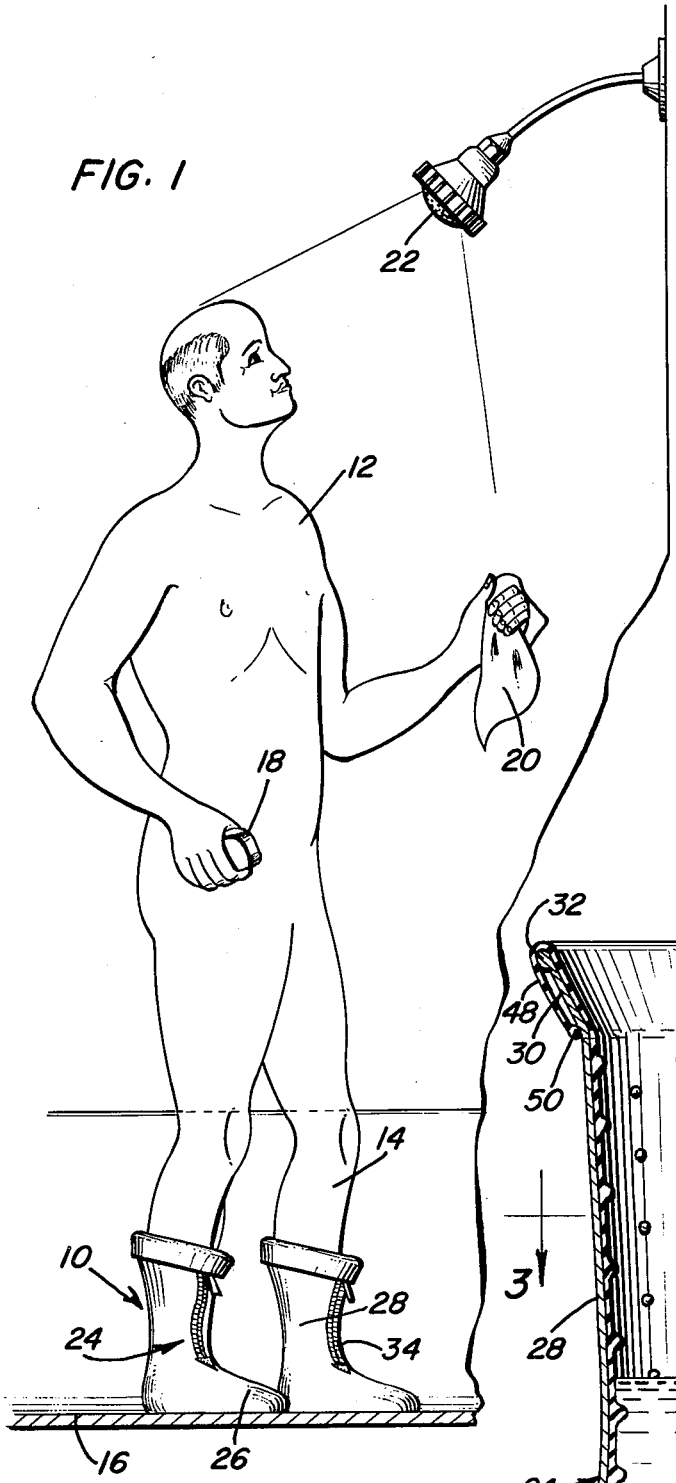
FIG. 1 is a diagrammatic view illustrating a pair of the shower boots of the present invention in use by a person taking a shower bath.
Figure 3:
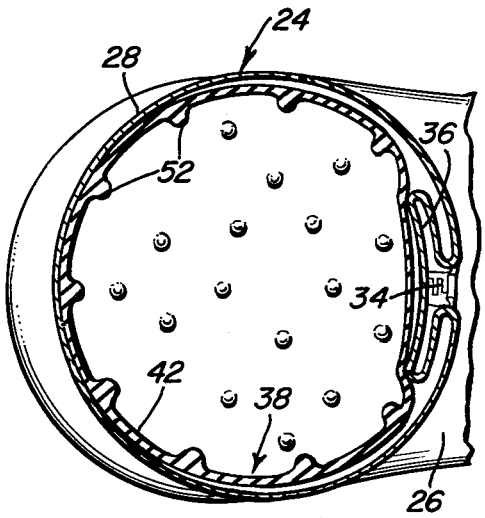
FIG. 3 is a transverse, plan sectional view taken substantially upon a plane passing along section line 3—3 of FIG. 2 illustrating further structural details of the invention.

Referring now specifically to the drawings, the shower boot of the present invention is generally designated by reference numeral 10 and, as illustrated in FIG. 1, a person 12 taking a shower bath places a boot 10 on each foot and adjacent leg portion 14 with the boot 10 adopted to engage the interior surface of a bath tub or shower stall 16 to prevent accidental slipping and at the same time effectively wash, scrub and massage the feet during the normal activities of the person 12, such as movements normally followed when applying soap from a bar of soap 18 and using a wash cloth 20 and varying the relationship to the shower head 22, all in a conventional manner. Such movements include shifting the weight from one foot to the other and moving the feet backwards and forwards, turning and twisting during which there will be some degree of movement between the boot 10 and the enclosed surfaces of the feet, ankles and leg portions 14.

Each boot 10 includes an outer or exterior body generally designated by the numeral 24 which includes a foot enclosing portion 26 having an antislip sole 27, an upwardly extending ankle and leg receiving portion 28 and an outwardly flared or tapered portion 30 at the upper end thereof terminating in a peripheral rib 32. Thus, the outer body 24 conforms in shape and configuration to the foot, ankle and leg region 14 of the person 12 and is constructed of waterproof, resilient, flexible material such as rubber, plastic, or the like, which is shape sustaining but still capable of flexing during walking movement and when placing the boot in position or removing it from the leg 14. The boot 10 is made somewhat larger than the portions of the foot and leg which it encloses to facilitate it being placed in position and also to facilitate relative movement between the surfaces of the foot and leg and the interior of the boot. Also, the front portion of the boot along the ankle and leg receiving area 28 is provided with a vertical zipper 34, snaps, or other closure means to retain normally spaced apart portions in proximity to each other with the spaced apart portions including an inwardly disposed closure in the form of a sealed tongue 36 to enable enlargement of this area to facilitate the boot being placed in position or removed from position with the zipper serving to snug the upper portion of the boot around the leg 14 in a conventional and well-known manner.

The boot 10 also includes an inner liner generally designated by numeral 38 which conforms with and engages the inner surface of the outer body 24. The inner liner also includes a foot enclosing portion 40, an upwardly extending ankle and leg enclosing portion 42 and an outwardly flared or tapering upper end portion 44 which is reversely folded over the rib 32 at the upper end thereof as indicated by numeral 46 with the free end portion of the liner then being disposed along the external surface of the outwardly flared top 30 of the outer body 24 as indicated at 48 with the lower terminal end of the liner including a rib designated by the numeral 50. The liner 38 is constructed of flexible, soft, resilient material, such as stretchable latex rubber or the like and the upper end of the liner is stretched outwardly and folded over the upwardly and outwardly tapering portion 30 of the outer body 24 thereby securing the liner in position and enabling replacement thereof when desired.

The inner surface of the liner 38 is provided with a plurality of projections 52 in the form of knobs, prongs, nipples, or the like, of unitary construction with the liner with these projections also being constructed of soft, resilient material, such as rubber, plastic, or the like, and being on the order of 3/32" in height, although this dimension may vary.

Figure 2:
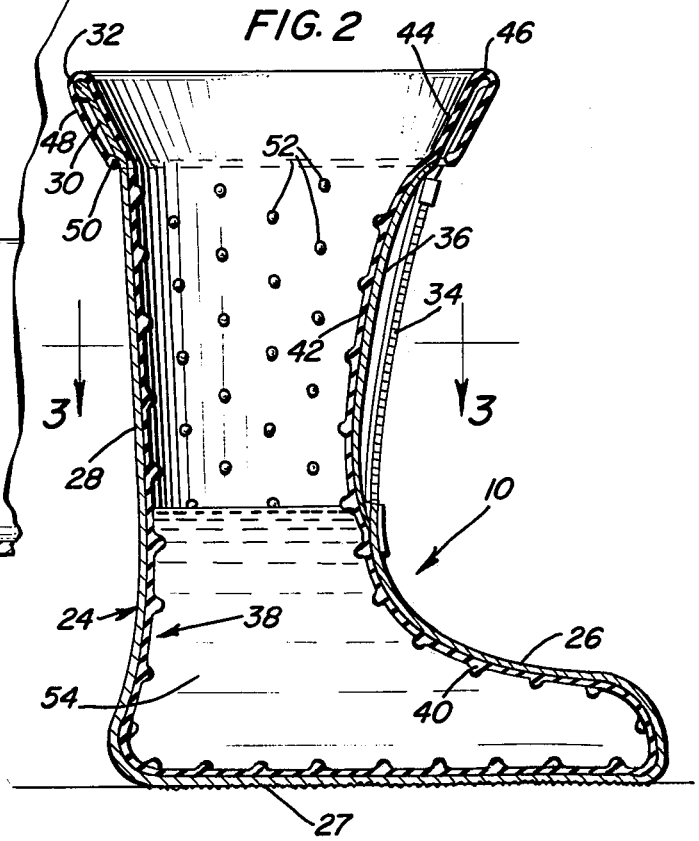
FIG. 2 is a vertical sectional view of a shower boot taken along the center line thereof, illustrating the structural details thereof.

With this construction, any water falling downwardly or running downwardly along the surfaces of the legs 14 will enter the boot with the outwardly flared upper end thereof funnelling such water into the boot. When the boot is to be used, a small quantity of liquid soap may be placed in each boot along with a quantity of water 54, as illustrated in FIG. 2, prior to the boot being placed on the foot. After the boots have been on the feet, a shower may be taken in a conventional manner during which time the movement of the feet causes a scrubbing action and rubbing or massaging action of the projections 52 and adjacent surfaces of the liner with the exterior surfaces of the feet, ankles and lower leg regions. Thus, the feet can be effectively washed without the necessity of balancing precariously on one foot while washing the other foot, holding onto a safety bar with one hand while accomplishing this feat or setting on the edge of the tub. Also, the boots provide a sense of safety in the tub since the tread surfaces or outer surface of the sole is provided with a tread which is of conventional construction and reduces the tendency of slippage occurring on the soapy wet internal surfaces of the bath tub 16. This device is especially useful for hospital patients, elderly people, or others who may have difficulty washing their feet or who find it is too strenuous or precarious.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A boot for use on each foot of a person taking a shower bath for soaking, scrubbing, washing and massaging the feet while the person is taking a shower bath, said boot comprising an outer body including a foot enclosing portion and an upwardly extending ankle and lower leg region enclosing portion shaped to conform with and enclose the corresponding foot, ankle and lower leg region of the person wearing the boot in a manner to enable limited relative movement between the boot and foot, ankle and leg region of the wearer, the upper end of the leg region enclosing portion of the boot being outwardly flared to funnel water into the interior of the boot as it falls downwardly or runs downwardly along the leg of the wearer, said outer body being constructed of resilient, flexible, shape sustaining, waterproof material, and an inner liner disposed within said outer body and conforming therewith, said inner liner being constructed of resilient, flexible material conforming with the interior of the outer body and including inwardly extending projections thereon for massaging, scrubbing and washing the external surfaces of the foot, ankle and lower leg region of the wearer.

2. The structure as defined in claim 1 wherein the upper end of the liner is resiliently stretchable and extends along the outwardly flared upper end of the outer body and is reversely folded downwardly over the top edge with the terminal upper end of the liner snapping into engagement against the outer surface of the outer body for securing the liner to the outer body and enabling replacement thereof when desired.

3. The structure as defined in claim 2 wherein said projections on the liner are smoothly rounded projections of soft, resilient material located throughout the area of the liner in spaced relation to each other to facilitate the scrubbing and massaging action during relative movement between the boot and the foot, ankle and lower leg region of the wearer during normal movements of these components when taking a shower bath.

4. The structure as defined in claim 3 wherein said outer body includes an anti-slip tread sole to prevent slipping on the inner surface of a bath tub or shower bath stall when taking a shower bath, the upwardly extending portion of the outer body including a sealed tongue and longitudinal fastening assembly to enable selective enlargement of the upwardly extending portion of the outer body to facilitate the boot being donned and removed.

5. The structure as defined in claim 1 wherein said liner is unattached to the outer body except at the exterior of the flared upper end to facilitate replacement of the liner.

6. The structure as defined in claim 1 wherein said projections are of unitary construction with the liner and are in the form of soft, resilient rounded nipples having a height on the order of approximately 3/32" to ¼".

* * * * *